US011787166B2

(12) United States Patent
Biegelsen

(10) Patent No.: US 11,787,166 B2
(45) Date of Patent: Oct. 17, 2023

(54) FOG DEVELOPMENT USING A FORMATIVE SURFACE

(71) Applicant: Palo Alto Research Center Incorporated, Palo Alto, CA (US)

(72) Inventor: David K. Biegelsen, Portola Valley, CA (US)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 17/546,108

(22) Filed: Dec. 9, 2021

(65) Prior Publication Data

US 2022/0227123 A1 Jul. 21, 2022

Related U.S. Application Data

(60) Provisional application No. 63/139,181, filed on Jan. 19, 2021.

(51) Int. Cl.
*B41M 1/06* (2006.01)
*B41F 7/02* (2006.01)
(Continued)

(52) U.S. Cl.
CPC ..... *B41F 13/08* (2013.01); *B41C 1/1041* (2013.01); *B41F 7/02* (2013.01); *B41F 7/08* (2013.01); *B41F 7/26* (2013.01); *B41F 31/002* (2013.01); *B41F 31/08* (2013.01); *B41F 31/13* (2013.01); *B41J 2/33535* (2013.01); *B41J 2/34* (2013.01);
(Continued)

(58) Field of Classification Search
CPC ..... B41P 2227/70; B41F 13/08; B41F 7/02; B41F 7/08; B41F 31/08; B41F 31/13; B41F 23/0409; B41F 31/06; B41F 31/20; B41F 31/28; B41F 7/00; B41C 1/1041;
(Continued)

(56) References Cited

U.S. PATENT DOCUMENTS 2,551,582 A 5/1951 Carlson
8,958,723 B2 2/2015 Liu
(Continued)

OTHER PUBLICATIONS

Co-Pending U.S. Appl. No. 17/152,630, filed Jan. 19, 2021.
(Continued)

*Primary Examiner* — Matthew G Marini
*Assistant Examiner* — Leo T Hinze
(74) *Attorney, Agent, or Firm* — Caesar Rivise, PC

(57) ABSTRACT

A formative surface having a conductive base covered with a dielectric and oleophobic/hydrophobic surface layer is created with defined pits to grow micro-puddles of a defined volume. The formative surface is brought into close proximity with a charge retentive surface carrying a charge image. Fountain solution vapor nucleates and grows preferentially on the base of the pits as micro-puddle droplets. The puddles are charged and extracted from the surface to provide a fog of charged droplets of narrow volume and charge distribution. The charged droplets are attracted and repelled respectively from the charged and discharged image regions of the charge retentive surface, thus developing the charged image into a fountain solution latent image. The developed latent image is then brought into contact with a transfer member blanket and split, thus creating on the blanket a fountain solution latent image ready for inking.

20 Claims, 6 Drawing Sheets

(51) Int. Cl.

| | |
|---|---|
| ***B41F 13/08*** | (2006.01) |
| ***B41J 2/34*** | (2006.01) |
| ***B41J 2/335*** | (2006.01) |
| ***B41C 1/10*** | (2006.01) |
| ***B41F 7/08*** | (2006.01) |
| ***B41F 7/26*** | (2006.01) |
| ***B41F 31/00*** | (2006.01) |
| ***B41F 31/13*** | (2006.01) |
| ***B41F 31/08*** | (2006.01) |
| ***B41N 3/03*** | (2006.01) |

(52) U.S. Cl.
CPC ..... *B41M 1/06* (2013.01); *B41N 3/03* (2013.01); *B41C 1/1033* (2013.01); *B41P 2227/70* (2013.01)

(58) Field of Classification Search
CPC ..... B41C 1/1033; B41M 1/06; B41M 5/0256; B41N 3/03
See application file for complete search history.

(56) References Cited

U.S. PATENT DOCUMENTS

| | | | | |
|---|---|---|---|---|
| 9,316,993 | B2 | 4/2016 | Veres et al. | |
| 10,744,754 | B2 | 8/2020 | Williams et al. | |
| 2012/0103212 | A1 | 5/2012 | Stowe et al. | |
| 2012/0103221 | A1 | 5/2012 | Stowe et al. | |
| 2013/0033686 | A1 | 2/2013 | Stowe et al. | |
| 2013/0247788 | A1* | 9/2013 | Liu | B41F 7/30 101/147 |
| 2014/0013980 | A1 | 1/2014 | Veres et al. | |
| 2017/0217150 | A1 | 8/2017 | Moore et al. | |
| 2022/0227114 | A1* | 7/2022 | Biegelsen | B41F 7/02 |
| 2022/0227118 | A1* | 7/2022 | Biegelsen | G03G 15/0208 |

OTHER PUBLICATIONS

Co-Pending U.S. Appl. No. 17/152,597, filed Jan. 19, 2021.
Co-Pending U.S. Appl. No. 17/152,574, filed Jan. 19, 2021.
Co-Pending U.S. Appl. No. 17/152,538, filed Jan. 19, 2021.
European Search Report to related European Patent Application No. 19185256.5 dated Jan. 13, 2020.

* cited by examiner

FOG DEVELOPMENT USING A FORMATIVE SURFACE

FIELD OF DISCLOSURE

The present disclosure is related to marking and printing systems, and more specifically to variable data lithography system using fog development of an electrographic image for creating a fountain solution image.

BACKGROUND

Offset lithography is a common method of printing today. For the purpose hereof, the terms "printing" and "marking" are interchangeable. In a typical lithographic process a printing plate, which may be a flat plate, the surface of a cylinder, belt and the like, is formed to have image regions formed of hydrophobic and oleophilic material, and non-image regions formed of a hydrophilic material. The image regions are regions corresponding to areas on a final print (i.e., the target substrate) that are occupied by a printing or a marking material such as ink, whereas the non-image regions are regions corresponding to areas on the final print that are not occupied by the marking material.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

A variable data lithography (also referred to as digital lithography) printing process usually begins with a fountain solution used to dampen a silicone imaging plate or blanket on an imaging drum. The fountain solution forms a film on the silicone plate that is on the order of about one (1) micron thick. The drum rotates to an exposure station where a high-power laser imager is used to remove the fountain solution at locations where image pixels are to be formed. This forms a fountain solution based latent image. The drum then further rotates to an inking station where lithographic-like ink is brought into contact with the fountain solution based latent image and ink transfers into places where the laser has removed the fountain solution. The ink is usually hydrophobic for better adhesion on the plate and substrate. An ultraviolet (UV) light may be applied so that photo-initiators in the ink may partially cure the ink to prepare it for high efficiency transfer to a print media such as paper. The drum then rotates to a transfer station where the ink is transferred to a print substrate such as paper. The silicone plate is compliant, so an offset blanket is not needed to aid transfer. UV light may be applied to the paper with ink to fully cure the ink on the paper. The ink is on the order of one (1) micron pile height on the paper.

The formation of the image on the printing plate/blanket is usually done with imaging modules each using a linear output high power infrared (IR) laser to illuminate a digital light projector (DLP) multi-mirror array, also referred to as the "DMD" (Digital Micromirror Device). The laser provides constant illumination to the mirror array. The mirror array deflects individual mirrors to form the pixels on the image plane to pixel-wise evaporate the fountain solution on the silicone plate to create the fountain solution latent image.

Due to the need to evaporate the fountain solution to form the latent image, power consumption of the laser accounts for the majority of total power consumption of the whole system. The laser power that is required to create the digital pattern on the imaging drum via thermal evaporation of the fountain solution to create a latent image is particularly demanding (30 mW per 20 um pixel, ~500 W in total). The high power laser module adds a significant cost to the system; it also limits the achievable print speed to about five meters per second (5 m/s) and may compromise the lifetime of the exposed components (e.g., micro-mirror array, imaging blanket, plate, or drum).

For the reasons stated above, and for other reasons which will become apparent to those skilled in the art upon reading and understanding the present specification, it would be beneficial to increase speed and lower power consumption in variable data lithography systems while improving fountain solution deposition.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a fountain solution delivery device for delivering fountain solution onto a target having a charge-retentive surface bearing an electrostatic charged pattern of charged regions thereon. The delivery device includes a fountain solution droplet generation member, a fountain solution vaporizer, and a surface charger. The droplet generation member is rotatable adjacent the target and includes a conductive layer having a reference potential, a dielectric layer above the conductive layer and an outer surface layer having a low surface free energy material. The outer surface layer has pits patterned therein down to the dielectric layer to form a droplet generating patterned outer layer. The fountain solution vaporizer is in communication with the droplet generating patterned outer layer to deposit fountain solution vapor to the outer surface pits. Fountain solution in the outer surface pits nucleate on the dielectric layer to form fountain solution droplets in the pits. The surface charger is specifically designed to charge the droplet generating patterned outer layer and at least one of the fountain solution vapor and the fountain solution droplets to form charged fountain solution droplets nucleated in the pits. The charged fountain solution droplets proximate to the target transfer under attraction from the pits to the charge-retentive surface and form a patterned fountain solution latent image on the target based on the electrostatic charged pattern.

According to aspects described herein, an imaging system is described. The imaging system is useful for printing with an ink-based image forming apparatus having a target rotatable imaging member with a charge-retentive surface bearing an electrostatic charged pattern of charged regions thereon. The imaging system includes an image forming unit adjacent the charge-retentive reimageable surface that forms the electrostatic charged pattern on the surface and a delivery device having a fountain solution droplet generation member, a fountain solution vaporizer, and a surface charger as summarized above and described in greater detail below.

According to aspects illustrated herein, an exemplary method for delivering fountain solution onto a target having a charge retentive surface bearing an electrostatic charged pattern of charged regions thereon. The method includes rotating a droplet generating patterned outer layer adjacent the charge retentive surface, depositing fountain solution vapor to the droplet generating patterned outer layer with a fountain solution vaporizer with fountain solution in the outer surface pits nucleating on the dielectric layer to form fountain solution droplets in the pits, charging the droplet generating patterned outer layer and at least one of the fountain solution vapor and the fountain solution droplets to form charged fountain solution droplets nucleated in the pits with a surface charger, and transferring the charged droplets proximate to the target under attraction from the pits to attach to the charge-retentive surface and form the patterned fountain solution latent image on the target based on the electrostatic charged pattern.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
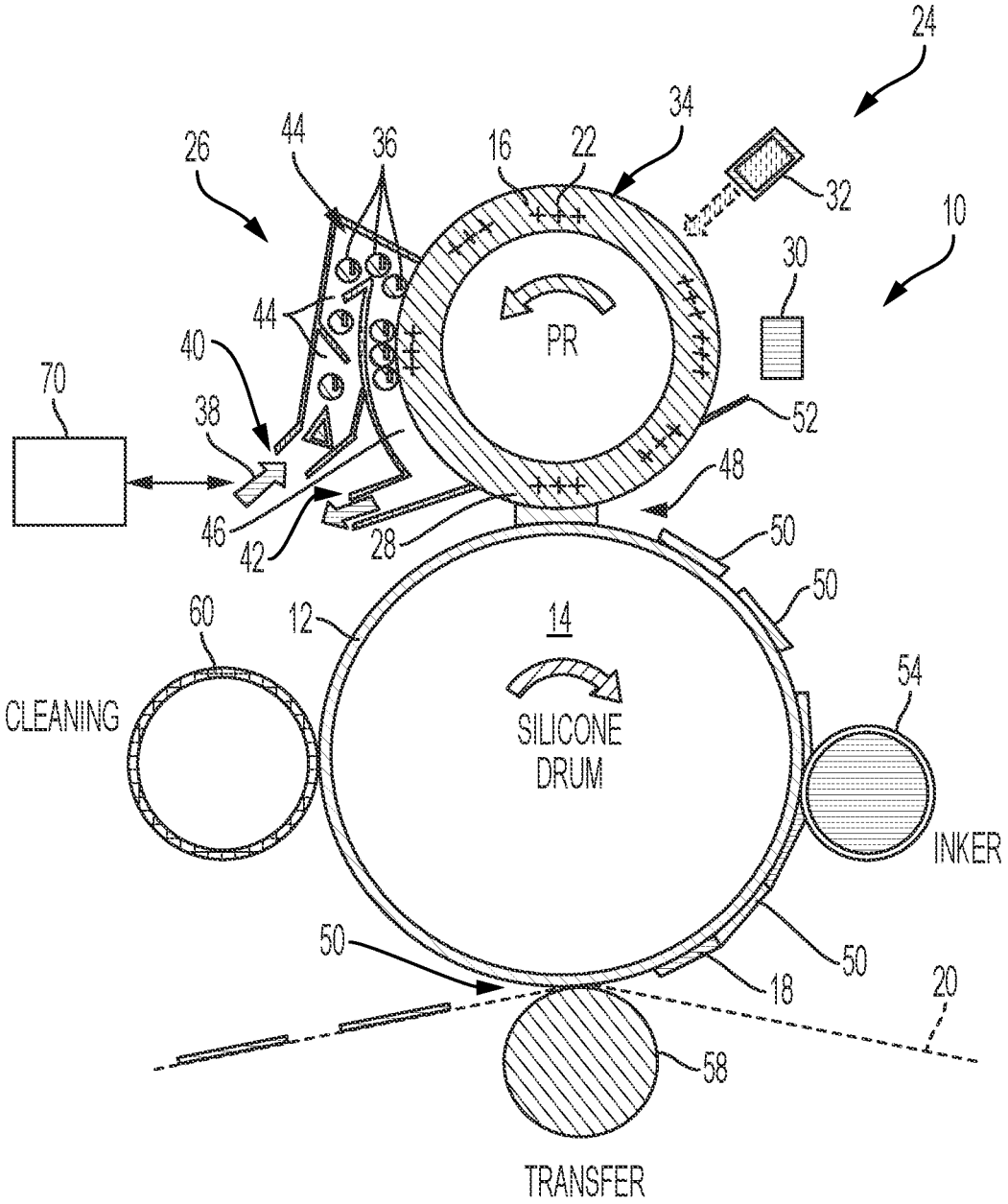
FIG. 1 illustrates a diagram of a related art ink-based digital printing system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may be non-aqueous including, for example, silicone fluids (such as D3, D4, D5, OS10, OS20, OS30 and the like), Isopar fluids, polyfluorinated ether, fluorinated silicone fluid and mixtures thereof.

The term "aerosol" refers to a suspension of solid and/or liquid particles in a gas. An aerosol may include both the particles and the suspending gas, which may be air, another gas or mixture thereof. The solids and/or liquid particles are sufficiently large for sedimentation, for example, as fountain solution on an imaging member surface. For example, solid or liquid particles may be greater than 0.1 micron, less than 5 microns, between about 0.5 and 2 microns and about 1 micron in diameter.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

FIG. 1 depicts an exemplary related art ink-based digital image forming apparatus 10 for variable data lithography including fog development of a charged fountain solution aerosol that forms a latent digital image created electrographically. The latent digital image is transferred to an inking blanket 12 of a transfer member 14 (e.g., roller, cylinder, drum) downstream an imaging member 16 for subsequent printing of an associated ink image 18 onto a print substrate 20. The imaging member 16 shown in FIG. 1 is a drum, but this exemplary depiction should not be read in a manner that precludes the imaging member 16 being a blanket, a belt, or of another known configuration. The image forming apparatus 10 includes the rotatable imaging member 16 having an arbitrarily reimageable surface 22 as different images can be created on the surface layer. In examples, the surface 22 is a charge-retentive surface such as but not limited to a photoreceptor surface or a dielectric surface. The reimageable charge-retentive surface 22 may be part of the drum or formed over a structural mounting layer that may be, for example, a cylindrical core, or one or more structural layers over a cylindrical core. The reimageable charge-retentive surface may be formed of a relatively thin layer over the mounting layer, a thickness of the relatively thin layer being selected to balance charge retaining performance, durability and manufacturability. The imaging member 16 is surrounded by an imaging station 24 configured to form an electrostatic charged pattern of a latent image on the imaging member surface 22, and an aerosol development device 26 that provides a fog of charged fountain solution aerosol particles that are attracted to the electrostatic charged pattern.

According to examples, fountain solution latent images 28 are created (e.g., xerographically, ionographically) on imaging member 16 and transferred to the inking blanket 12 for further processing. At the imaging station 24, a charging device 30 charges the imaging member surface 22, for example by corona discharge from a high voltage power source via a conductor of the charging device adjacent the charge-retentive imaging member surface 22. In electrography or xerography an imager 32 having a low power light source (e.g., a laser with a conventional ROS scanner, LED bar) selectively discharges select portions or pixels of the surface 22 according to image data to generate an electrostatic charged pattern 34 disposed on the surface of the imaging member 20. In ionography the imager 32 includes an image projection head for projecting ion beams, i.e., ions of a given polarity, onto the charge-retentive surface 22 after the surface is charged by the charging device 30. The surface 22 shown could be a photoreceptor, but when the application is ionographically created, an insulating surface could be used to create the charge image.

The aerosol development device 26 presents a charged patterned uniform layer of fountain solution (e.g., silicone fluids, such as D4, D5, Isopar G, Isopar H, Dowsil OS20, Dowsil OS30, L5; water/IPA mixtures, hydrophilic fluids, and mixtures thereof) aerosol particles 36 in solid or liquid particle form onto the surface 22 of the imaging member 16. The fountain solution aerosol particles 36 are configured to adhere to portions of the imaging member surface 22 according to the electrostatic charged pattern 34 developed thereon by imager 32. In examples, charged fountain solution aerosol particles 36 of opposite polarity of the imaging member surface 22 are deposited onto the electrostatic charged pattern 34, and form a fountain solution latent image 28 on the imaging member surface. In other examples, charged fountain solution aerosol particles 36 of the same polarity as the imaging member surface 22 would be deposited on the neutral pixels thereof.

The aerosol development device 26 atomizes and charges fountain solution 38 into charged fountain solution aerosol particles 36 that enter an inlet port 40. In examples, a pump may supply fountain solution from a container housing the fountain solution to an aerosol generator (e.g., a nebulizer) at a steady, controlled rate. The fountain solution may contain charge control agents (e.g., surfactants, polymer solution, salts), to assist particle charging, as well understood by a skilled artisan. The aerosol development device 26 further includes a manifold having walls 62 defining a chamber 44 and a radially enlarged region 46 near the imaging member surface 22 where a fog of charged fountain solution aerosol particles 36 may carry the atomized fountain solution to the electrostatic charged pattern 34 on the surface of imaging member 16.

A carrier gas such as nitrogen, added in a predetermined amount, may be introduced into the developer unit chamber 44 via inlet port 40 to carry the atomized fountain solution aerosol particles 36 to the surface 22 of imaging member 16 as a gas mixture, where they may be attracted to the electrostatic charged pattern 34 and bond to the charge-retentive reimageable surface 22 and form a fountain solution latent image 28. The gas mixture transporting the atomized fountain solution aerosol particles includes the carrier gas and a controlled partial pressure of fountain solution. This partial pressure of fountain solution may solely originate from evaporated fountain solution or a controlled additional vaporized fountain solution. An increase in the partial pressure of the fountain solution will slow down the evaporation from the fountain solution droplets. The partial pressure may be modified, for example, by the controller adding vaporized fountain solution to the gas mixture, as well understood by a skilled artisan.

The surface charge density (created by charging device 30) of the latent image attracts a volume of fountain solution aerosol particles 36 until the surface charge is optionally neutralized or partially neutralized by the fog charged aerosol. Adhesion forces with the imaging member 16 and each other will cause the aerosol particles to remain on the surface 22 of the imaging member.

Aerosol particles 36 do not bond to the surface 22 of imaging member 16 where no latent image charge resides. The aerosol particles 36 can also be electrostatically repelled from uncharged regions of the electrostatic charged pattern 34, for example, via voltage applied to walls of the development device 26. Aerosol particles 36 that do not bond to the imaging member surface 22 may exit the developer unit 20 via outlet port 42 and flow back to the fountain solution container. A vapor vacuum or air knife (not shown) may be positioned adjacent the downstream side of the radially enlarged region 46 near the outlet port 42 to collect unattached aerosol particles and thus avoid leakage of fountain solution into the environment. Reclaimed fountain solution particles can also be condensed and filtered as needed for reuse as understood by a skilled artisan to help minimize the overall use of fountain solution by the image forming device 10.

The transfer member 14 may be configured to form a fountain solution image transfer nip 48 with the imaging member 16. A fountain solution image produced by the developer unit 26 and imaging station 24 on the surface 22 of the imaging member 16 is transferred to the inking blanket 12 of the transfer member 14 under pressure at the loading nip 48. In particular, a light pressure (e.g., a few pounds, greater than 0.1 lbs., less than 10 lbs., about 1-4 lbs.) may be applied between the surface of the inking blanket 12 and the imaging member surface 22. At the fountain solution transfer nip 48, the fountain solution latent image 28 splits as it leaves the nip and transfers a split layer of the fountain solution latent image, referred to as the transferred fountain solution latent image 50, to the transfer member surface (i.e., inking blanket 12). The amount of fountain solution transferred may be adjusted by contact pressure adjustments of nip 48. For example, a split fountain solution latent image 50 of about one (1) micrometer or less may be transferred to the inking blanket surface. Like the imaging member 16, the transfer member 14 may be electrically biased to enhance loading of the dampening fluid latent image at the loading nip 48.

After transfer of the fountain solution latent image from the imaging member 16, the imaging member 16 may be cleaned in preparation for a new cycle by removing dampening fluid and solid particles from the surface at a cleaning station 52. Various methods for cleaning the imaging member surface 22 may be used, for example an air knife and/or sponge, as well understood by a skilled artisan.

After the fountain solution latent image 50 is transferred to the transfer member 14, ink from an inker 54 is applied to the inking blanket 12 to form an ink pattern or image 18. The inker 54 is positioned downstream fountain solution transfer nip 48 to apply a uniform layer of ink over the transferred fountain solution latent image 50 and the inking blanket 12. While not being limited to a particular theory, the ink pattern or image 18 may be a negative of or may correspond to the fountain solution pattern. For example, the inker 54 may deposit the ink to the evaporated pattern representing the imaged portions of the reimageable surface 26, while ink deposited on the unformatted portions of the fountain solution will not adhere based on a hydrophobic and/or oleophobic nature of those portions. The ink image 18 may be transferred to print media or substrate 20 at an ink image transfer nip 56 formed by the transfer member 14 and a substrate transport roll 58. The substrate transport roll 58 may urge the print substrate 20 against the transfer member surface, or inking blanket 12, to facilitate contact transfer of the ink image 18 from the transfer member 14 to the print substrate.

After transfer of the ink image 18 from the transfer member 14 to the print media 20, residual ink may be removed by a cleaning device 60. This residual ink removal is most preferably undertaken without scraping or wearing the imageable surface of the imaging blanket 12. Removal of such remaining fluid residue may be accomplished through use of some form of cleaning device 60 adjacent the imaging blanket 12 between the ink image transfer nip 56 and the fountain solution transfer nip 48. Such a cleaning device 20 may include at least a first cleaning member such as a sticky or tacky roller in physical contact with the imaging blanket surface, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste.

It is understood that the cleaning device 60 is one of numerous types of cleaning devices and that other cleaning devices designed to remove residual ink/fountain solution from the surface of imaging blanket 12 are considered within the scope of the embodiments. For example, the cleaning device could include at least one roller, brush, web, belt, tacky roller, buffing wheel, etc., as well understood by a skilled artisan. It is also understood that the cleaning device 60 may be more sophisticated or aggressive at removing residual fluids from imaging blanket 12 that the cleaning station 52 is at removing fountain solution from the surface 22 of the imaging member 16. Cleaning station 52 is not concerned with removing residual ink, and merely is designed to remove fountain solution and associated contaminates from the surface 22.

The exemplary ink-based digital image forming devices and operations thereof may be controlled by a controller 70 in communication with the image forming devices and parts thereof. For example, the controller 70 may control the imaging station 24 to create electrostatic charged patterns of latent images on the imaging member surface 22. Further, the controller 70 may control the aerosol development device 26 or other aerosol development devices discussed in greater detail below to provides the fog of charged fountain solution aerosol particles that are attracted to the electrostatic charged pattern. The controller 70 may be embodied within devices such as a desktop computer, a laptop computer, a handheld computer, an embedded processor, a handheld communication device, or another type of computing device, or the like. The controller 70 may include a memory, a processor, input/output devices, a display and a bus. The bus may permit communication and transfer of signals among the components of the controller 70 or computing device, as will be described in greater detail below.

Figure 2:
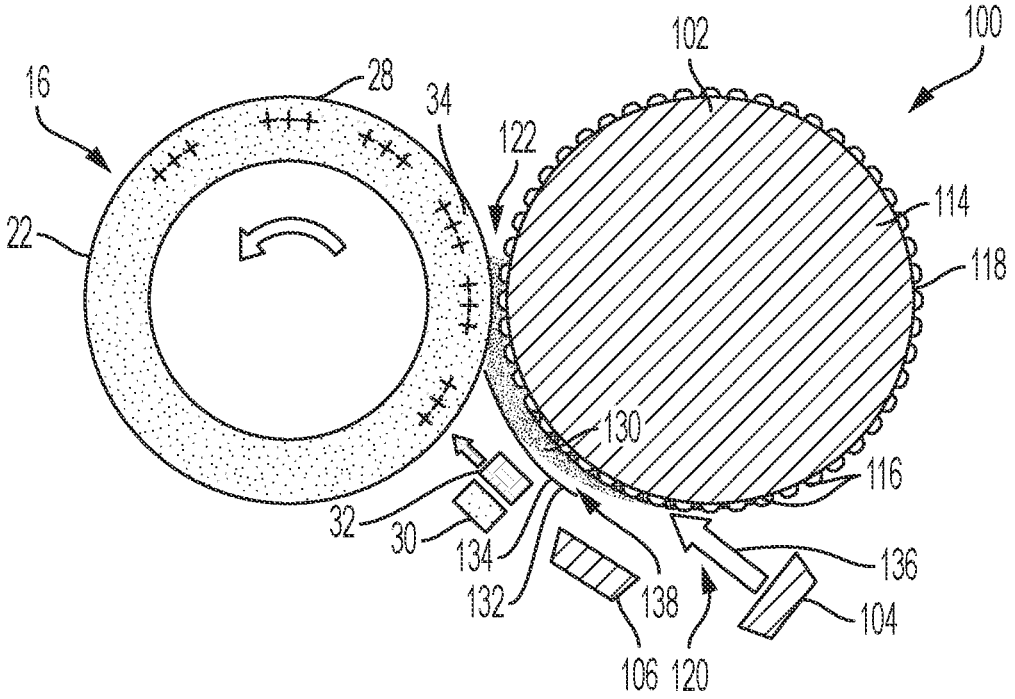
FIG. 2 is a side view partially in cross of a fountain solution delivery device in accordance with examples of the embodiments.

In related art examples a charged aerosol fog created by charging nebulized droplets may produce a distribution in droplet sizes that leads to some uncertainty in the charge to volume ratios of the droplets, and to uncertainties in the volume of fountain solution delivered by aerosol development devices 26 to pixels of the charge retentive reimageable surface 22. FIG. 2 depicts an exemplary fountain solution delivery device 100 for delivering fountain solution onto a target (e.g., imaging member 16) having a charge-retentive surface 22 bearing an electrostatic charged pattern 34 of charged regions thereon. While the fountain solution delivery device 100 has some similarities to the aerosol development device 26, such as it delivers charged fountain solution to the charge-retentive surface 22, the fountain solution delivery device may deliver fountain solution droplets having a smaller distribution in size, (i.e., more uniformly sized) to the charge-retentive surface than related art approaches.

Fountain solution 38 may be delivered by the fountain solution delivery device 100 to the charge retentive reimageable surface 22 from a formative surface with defined pits. As will be described in greater detail below, the formative surface has small (e.g., micron-sized) pits in a very low surface energy field on which fountain solution vapor is condensed. Fountain solution vapor may nucleate and grow into droplets in the pits. The droplets may be charged and extracted from the formative surface to create a charged fog as the surface approaches a development nip or zone adjacent the target charge-retentive surface 22. The fountain solution 38 wets portions of the imaging member surface 22 and forms a latent image according to the electrostatic charged pattern 34 developed thereon by imager 32. Accordingly, the fountain solution delivery device 100 may improve upon the aerosol development device 26 described above, and may associate with the controller 70 in similar manner. Further, the fountain solution delivery device 100 may provide improved image quality due to more uniform droplet size and charge/mass ratio, as will be described in greater detail below. The developed fountain solution latent image may be transferred from the imaging member 16 onto inking blanket 12 for subsequent processing.

The fountain solution delivery device 100 may be part of an imaging system useful for printing with the ink-based digital image forming device 10 (FIG. 1) onto a target, for example, the rotatable imaging member 16 having a charge-retentive reimageable surface 22 bearing an electrostatic charged pattern 34. A rotatable inking blanket 12 (or belt) downstream the imaging member has a surface in rolling communication with the charge-retentive surface 22 and may be conformable to accept a patterned fountain solution latent image 28 and transfer an ink image 18 corresponding to the electrostatic charged pattern 34 to a substrate 20. The inking blanket 12 may include, for example, hydrophobic polymers such as silicones, partially or fully fluorinated fluorosilicones and FKM fluoroelastomers. Other materials may be employed, including blends of polyurethanes, fluorocarbons, polymer catalysts, platinum catalyst, hydrosilyation catalyst, etc. The surface may be configured to conform to a print substrate on which an ink image is printed. To provide effective wetting of fountain solutions such as water-based dampening fluid, the silicone surface need not be hydrophilic, but may be hydrophobic. The inking blanket 12 may have high electrical resistivity and finite conductivity to avoid charge buildup on the blanket.

Referring to FIG. 2, the fountain solution delivery device 100 is positioned adjacent (e.g., 3 microns-5 mm, 5 microns-1 mm, 5-100 microns) the target rotatable imaging member 16, and may be combined with the imaging station 24 (FIG. 1) to form an imaging system useful for printing with the ink-based digital image forming device 10. As can be seen in FIG. 2, the fountain solution delivery device 100 includes a fountain solution droplet generation member 102, a fountain solution vaporizer 104 and a surface charger 106. The fountain solution (FS) droplet generation member 102 is rotatable adjacent (e.g., 3 microns-5 mm, 5 microns-1 mm, 5-100 microns) the target rotatable imaging member 16, and may be shaped as a roller or belt, yet is not limited to either configuration. In examples the FS droplet generation member 102 has a conductive layer 108 and a formative outer surface 118 including a dielectric layer 110 above the conductive layer and an outer surface layer 112 above the dielectric layer. See FIGS. 3-8. The conductive layer 108 may have a reference potential (e.g., biased to a desired voltage such as between about −1000V and 1000V, or between about −400V and 400V, where the sign and magnitude are preferably approximately equal to half the value of the potential of the imaging member 16 in the fully charged and discharged states).

Referring back to FIG. 2, the fountain solution droplet generation member 102 is rotatable adjacent and in close proximity (e.g., 3 microns-5 mm, 5 microns-3 mm, 100-1000 microns) to the target rotatable imaging member 16 at a near-nip gap 122 therebetween. The close proximity at the gap 122 allows for fountain solution transfer from the droplet generation member 102 to the target imaging member 16, for example, as will be discussed in greater detail below. In examples, a spacer 140 (FIG. 6) may be provided between the droplet generation member and the charge retentive surface 22 to maintain the gap 122 at a set distance. For example, the spacer may be made of a Teflon or hard dielectric with hydrophobic/oleophobic coating as fins or spacers. The spacer(s) may be attached to one of the rolls, for example the droplet generation member 102 as a rib protruding around the roll circumference near the outer ends thereof to contact the target charge retentive surface at non-imaging regions thereof and maintain the gap over the electrostatic charged pattern.

The conductive (e.g., metal, aluminum, steel, silver) layer 108 is a structural support layer that may be, for example, a cylindrical, ellipsoidal or oblong cylindrical core 114, or one or more structural layers over the core. The core may be solid, rigid, compliant, hollow or some combination thereof. A hollowed core may be designed to allow fluid therein to help control the temperature of the droplet generation member and layers thereof, including the dielectric and outer surface layers, as well understood by a skilled artisan. For example, fluid having a temperature lower than the temperature of the conductive and patterned outer layers may flow within the hollow core to help cool the layers.

The dielectric layer 110 is formed over the conductive structural mounting layer 108 and may have a thickness in the range of, for example, 5 microns to 10 mm, or 50 microns to 1 mm, or 100 microns to 500 microns. The dielectric (e.g., silicone, PDMS, plastic, rubber, ceramic) 110 may be covered or coated with the outer surface layer 112 having a thickness in the range of, for example, 0.005-20 microns, or 0.01-10 microns, or 0.1-3 microns. While not being limited to a particular theory, the dielectric layer 110 may be formed by casting the layer on a topographically patterned master, curing the layer and separating it from the patterned master. A back side of the dielectric layer may then be bonded to the conductive layer 108. Alternatively, the dielectric layer 110 may be a photo-developable layer such as a photo-resist that is spun or dip coated onto the conductive layer 108 or onto a continuous non-developable dielectric layer. Exposure using a mask or laser illumination followed by development can then provide a seamless pit pattern in the developable layer, as described in greater detail below.

The outer surface layer 112 includes a material having a very low surface free energy (e.g., hydrophobic, oleophobic). Very low surface free energy refers to a surface that is at least one of hydrophobic and oleophobic. For the outer surface material to be hydrophobic, the surface free energy of the material must be lower than the surface tension of water, about 72.8 mN/m. For a surface to be oleophobic, the surface free energy has to be lower than about 30 mN/m, which is a typical surface tension value for oil, or even lower than about 20 nM/m. The outer surface layer 112 material may include fluoropolymer or other perfluorinated materials (e.g., PFCs (perfluorinated chemicals), PFASs (perfluoroalkyl substances), Teflon chemicals, Teflon). In addition, the outer surface layer material may be surface nanotectured to enhance its hydrophobicity and or its oleophobicity. The dielectric material layer 110 on which the outer surface layer material is deposited should also have low surface energy, but not as low as the outer surface layer 112.

In examples, the outer surface layer 112 includes micron sized pits 116 patterned therein down to at least the dielectric layer 110. The pits (FIGS. 3-8) may be formed through the very low surface energy outer surface layer 112, for example by lithography (e.g., photo or electron beam), embossment, etching, engraving, die casting, molding, laser ablation or other approaches understood by a skilled artisan, revealing the higher surface energy dielectric surface below. In certain examples the pits may extend into the dielectric layer 10, and that further extension is considered within the scope of embodiments. Pit 116 diameters may be in the range of 0.5-10, or 1-8, or 2-5 microns. Pit depths may correspond to about the thickness of the outer surface layer 112, and may be up to nearly the thickness of the outer surface layer and dielectric layer 110 combined. The outer surface layer 112 in examples may be generated by spinning an organic fluoropolymer (e.g., Cyclic Transparent Optical Polymer, CYTOP M) onto a silicon dielectric layer 110 and opening pits 116 down to the silicon using photolithography and oxygen plasma etching. Further, the pits are not limited by shape, and may be hemispherical, cylindrical, semi-ellipsoidal, prism shaped, cone shaped, trapezoid prism, hexagonal, pyramidal, tetrahedronal, cuboidal, etc. The outer surface layer 112 thus has pits 116 that may be patterned therein down to the dielectric layer 110 to form a droplet generating patterned formative outer layer 118, as can be seen for example in FIGS. 3-8.

The fountain solution vaporizer 104 provides a fountain solution vapor 120 to the patterned outer layer 118. An arrow 136 indicates an air flow that carries the fountain solution vapor through an opening into a baffled zone 138 between the patterned outer layer and a baffle 134. The air flow may be created from the droplet generation member 102 spinning and entraining the air flow, and/or a separate air source (e.g., fan (not shown)) which may help to control the flow of air by forcing either dry air or air with some FS vapor into the baffled zone 138.

Figure 3:
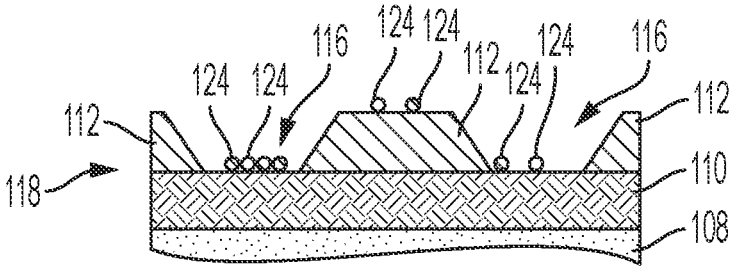
FIG. 3 is a side view in cross of an exemplary fountain solution droplet generation member section with condensed fountain solution vapor particles thereon.
Figure 4:
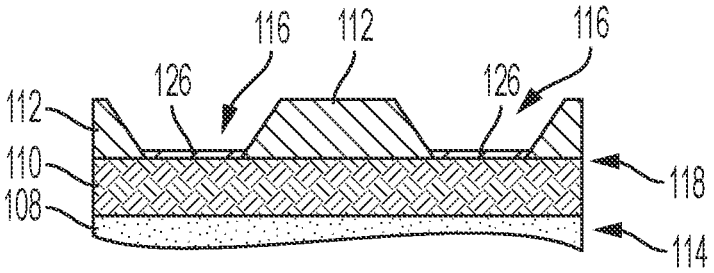
FIG. 4 is a side view in cross of the exemplary fountain solution droplet generation member section of FIG. 3 with congregated nucleated fountain solution particles thereon.
Figure 5:
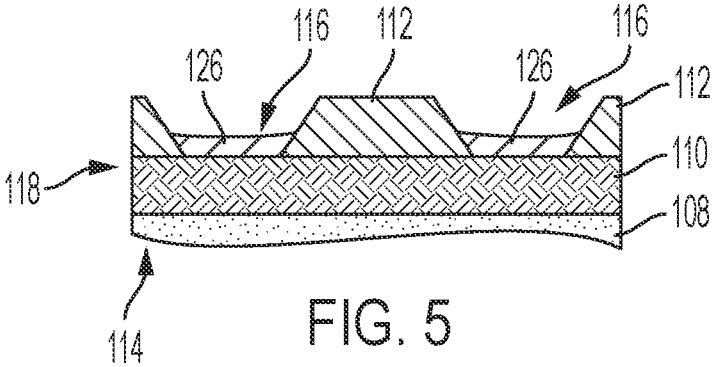
FIG. 5 is a side view in cross of the exemplary fountain solution droplet generation member section of FIG. 3 with congregated nucleated fountain solution particles growing as micro-sized puddles.
Figure 6:
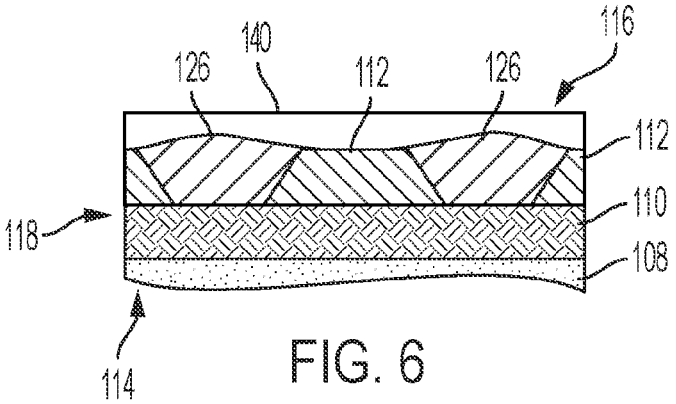
FIG. 6 is a side view in cross of the exemplary fountain solution droplet generation member section of FIG. 3 with micro-size puddle droplets.
Figure 7:
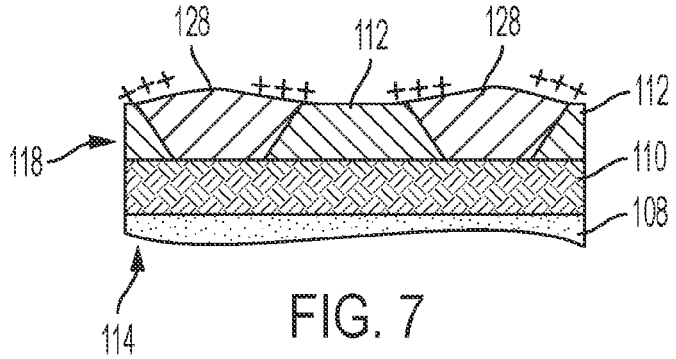
FIG. 7 is a side view in cross of the exemplary fountain solution droplet generation member section of FIG. 3 with charged micro-size puddle droplets.

FIGS. 3-8 depict an exemplary fountain solution development approach. As can be seen in FIG. 3, fountain solution vapor 120 at the patterned outer layer 118 condenses on the pitted outer layer 118. Condensed vapor molecules 124 congregate on the base of the pits 116 and nucleate thereon, with molecules on the outer surface layer 112 tending to migrate to the pits due to the very low surface free energy of the outer surface layer material. The fountain solution vapor nucleates and grows as additional condensed fountain solution vapor 120 molecules congregate, typically on the base of the pits 116 (FIGS. 4-5) and fill the pits reaching micro-puddle size (FIG. 6). Micro sized fountain solution droplets or puddles 126 are thereby produced as the formative outer layer 118 rotates through the fountain solution vapor 120. The volume of the puddles 126 may be limited by controlling the vapor flow rate and droplet generation member rotational speed, as well understood by a skilled artisan.

As noted above the conductive layer is biased to a desired reference potential (e.g., biased to a desired voltage such as ground, less than about −400V, about −100V) as understood by a skilled artisan, for example via conductive coupling to the referenced potential. In examples the conductive layer may be biased to lie about halfway between the potential of the charged and discharged regions of the electrostatic charged pattern 34 on the charge retentive reimageable surface 22.

Referring back to FIG. 2, the fountain solution delivery device surface charger 106 is spatially offset from the patterned outer layer 118 upstream the near-nip gap 122 in the rotation direction of the droplet generation member 102. The surface charger 106 may be an electrical discharger (e.g., scorotron, corotron) designed to drive a flux of ions through fountain solution between the surface charger and dielectric layer and charge the dielectric layer 110 and fountain solution. The surface charger may include a high voltage source that can charge the fountain solution by any of numerous approaches including by corona discharge, induction, conduction, and tribocharging as discussed herein by examples and understood by a skilled artisan. While not being limited to particular values, the surface charger 106 voltage may be greater than 1 kV, less than 20 kV, or about 6-10 kV, and provide a current dependent on process direction speed (e.g., less than about 10 μA/cm, less than 2 μA/cm, about 1 μA/cm to 20 nA/cm, about 1.5 μA/60 mm or 250 nA/cm) in the cross-process direction to the patterned outer layer 118.

The fountain solution charged by the surface charger 106 may be in different forms, such as the micro puddles 126 in the pits 116, condensed vapor molecules 124 on the patterned outer layer 118 or congregated/nucleated in the pits 116, and even the fountain solution vapor 120 between the surface charger 106 and dielectric layer 110. In other words, the surface charger may charge the fountain solution during or after its nucleation and accretion. The charged fountain solution vapor fog condenses on the pitted outer layer 118 as charged condensed vapor particles, and charged condensed vapor particles still congregate, nucleate and grow on the base of the pits 116, resulting in charged fountain solution micro puddles 128. Accordingly, fountain solution charged by the surface charger 106 becomes charged fountain solution micro puddles 128 (FIG. 7) regardless of the form of the fountain solution when it is charged.

Figure 8:
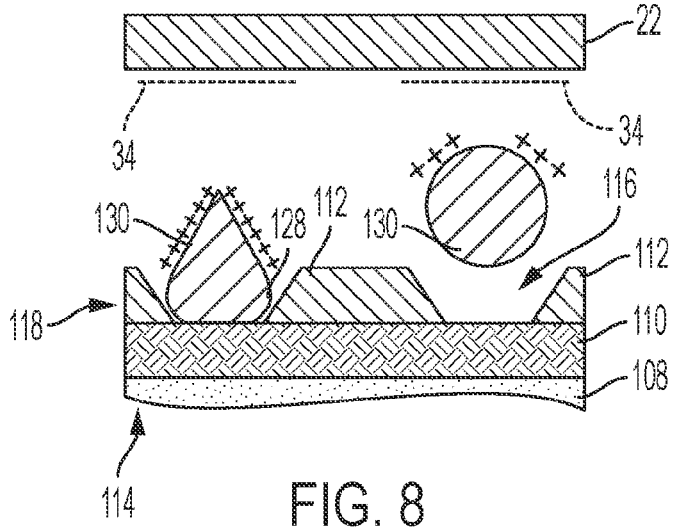
FIG. 8 is a side view in cross of the exemplary fountain solution droplet generation member section of FIG. 3 adjacent a charge retentive surface at a near-nip gap therebetween.

Still referring to FIG. 2, as the droplet generation member 102 continues its rotation, charged fountain solution micro puddles 128 in the patterned outer layer pits 116 approach the near-nip gap 122 and come close to or proximate the charge retentive surface 22. FIG. 8 depicts the patterned outer layer 118 proximate the charge retentive surface 22 within a development region between the two surfaces adjacent to and including the near-nip gap 122. The charged fountain solution micro puddles 128 are electrically biased or charged to cause the micro puddles to adhere to portions of the charge retentive reimageable surface 22 having complementary electrostatic charge (e.g., electrostatic charged pattern 34). As can be seen in FIG. 8, within the development region, charged fountain solution micro puddles 128 in the pits 116 proximate the electrostatic charged pattern 34 migrate from the pits as charged droplets 130 under attraction to the electrostatic charged pattern and adhere to the charge retentive surface 22 forming a patterned fountain solution latent image 28 on the charge retentive surface based on the electrostatic charged pattern. In particular, the charged droplets 130 are attracted and repelled respectively from the charged and discharged image regions of the electrostatic charged pattern, thus developing the charged pattern into a fountain solution image.

To help facilitate the migration of the charged micro puddles 128 across the gap from the pits 116, the fountain solution delivery device may include an electric field generator 132 intentionally designed to generate an electric field between the droplet generation member 102 and the charge retentive surface 22 and extract the charged micro puddles from the pits. In examples, before and/or as the charged fountain solution micro puddles 128 enter the development region between the charge retentive surface 22 and the formative patterned outer layer 118, the electric field generator 132 generates a strong electric field (e.g., <10 kV/mm, less than about 2 kV/mm) that may extract the charged micro puddles from the low energy surfaces of the dielectric layer 110 and outer surface layer 112 and create a fog of charged droplets 130 having narrow volume and charge distribution due to the pits 116 being the same or nearly the same size. The electric field generator 132 may generate an electric field having both DC and AC voltage, as the DC voltage may help to extract the droplets from the pits 116, and the AC voltage may help to keep the migrating charged droplets 130 suspended in the fog between the charge retentive surface 22 and the patterned outer layer 118 until attraction to the electrostatic charged pattern 34 pulls the charged droplets to the charge retentive surface.

In examples the electric field generator 132 may include a baffle 134 between the fountain solution droplet generation member 102 and the charge retentive surface 22. As can be seen in FIG. 2, the baffle 134 may be spatially offset and extend around the patterned outer layer 118 to proximate the imaging member charge retentive surface 22 in a manner that confines the fog of charged droplets 130 between the baffle and the droplet generation member until access to the charge retentive surface at the development region beyond the baffle. The baffle 134 may generate the electric field, as discussed above and well understood by a skilled artisan.

In operation, the patterned outer layer 118 of the droplet generation member 102 and charge retentive reimageable surface 22 of the imaging member 16 rotate adjacent each other. The imaging member 16 and droplet generation member 102 may be driven, for example, by a motor or rotated via rolling contact with another roller or belt, as understood by a skilled artisan. The fountain solution vaporizer 104 deposits the fountain solution vapor fog 120 to the patterned outer layer 118 for droplet generation thereon. Fountain solution vapor molecules condense, nucleate, congregate and grow as micro-puddle size droplets 126 in the pits 116. Before and after the droplets are fully formed, surface charger 106 charges the droplet generating patterned outer layer, the fountain solution vapor 120 and/or the fountain solution droplets 126 to form charged fountain solution droplets 128 nucleated in the pits 116.

As the droplet generation member 102 continues its rotation, electric field generator 132 downstream the surface charger 106 in the rotating processing direction of the patterned outer layer 118 generates an electric field between the patterned outer layer and the charge retentive reimageable surface 22. The generated electric field may include both DC voltage and AC voltage components. The electric field aids extraction of the charged fountain solution droplets from the pits 116 and migration into a fog of charged droplets 130. In the development zone between the rotating patterned outer layer 118 and charge retentive reimageable surface 22, the charged droplets 130 transfer under attraction and attach to the target charge-retentive surface at the electrostatic charged pattern and form a patterned fountain solution latent image 28 on the charge-retentive surface based on the electrostatic charged pattern. The patterned fountain solution latent image may then be transferred to the inking blanket 12 for further processing, for example as discussed above.

Figure 9:
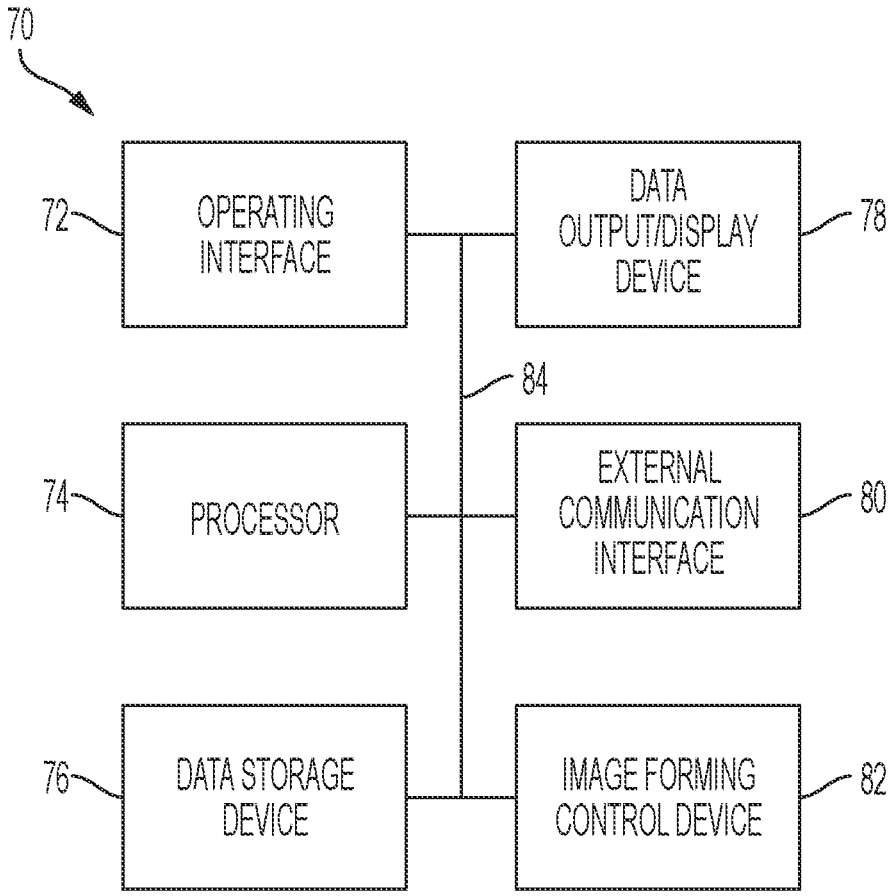
FIG. 9 is a block diagram of a controller with a processor for executing instructions to automatically control components of the digital image forming device and fountain solution delivery device in accordance with examples.

FIG. 9 illustrates a block diagram of the controller 70 for executing instructions to automatically control the ink-based digital image forming device 10, fountain solution delivery device 100 and components thereof. The exemplary controller 70 may provide input to or be a component of a controller for executing image formation methods in a system such as that depicted in FIGS. 1-8 and described in greater detail below in FIG. 10.

The exemplary controller 70 may include an operating interface 72 by which a user may communicate with the exemplary control system. The operating interface 72 may be a locally-accessible user interface associated with the digital image forming device 10 and fountain solution delivery device 100. The operating interface 72 may be configured as one or more conventional mechanism common to controllers and/or computing devices that may permit a user to input information to the exemplary controller 70. The operating interface 72 may include, for example, a conventional keyboard, a touchscreen with "soft" buttons or with various components for use with a compatible stylus, a microphone by which a user may provide oral commands to the exemplary controller 70 to be "translated" by a voice recognition program, or other like device by which a user may communicate specific operating instructions to the exemplary controller. The operating interface 72 may be a part or a function of a graphical user interface (GUI) mounted on, integral to, or associated with, the digital image forming device 10 and fountain solution delivery device 100 with which the exemplary controller 70 is associated.

The exemplary controller 70 may include one or more local processors 74 for individually operating the exemplary controller 70 and for carrying into effect control and operating functions for image formation onto a print substrate 20, including but not limited to forming an electrostatic charged pattern 34 on the charge retentive reimageable surface 22, rotating the droplet generation member 102, depositing the fountain solution vapor fog 120 adjacent the patterned outer layer 118, charging the patterned outer layer, the fountain solution vapor and/or the fountain solution droplets 126 to form charged fountain solution droplets 128 nucleated in the pits 116, generating an electric field between the patterned outer layer and the charge retentive reimageable surface 22, transferring the charged fountain solution droplets under attraction for attachment to the target charge-retentive surface at the electrostatic charged pattern to form a patterned fountain solution latent image 28 on the charge-retentive surface based on the electrostatic charged pattern, transferring the fountain solution latent image from the imaging member 16 to an inking blanket 12 surface of an inked image transfer member 14, depositing a layer of ink over the latent image to form an ink image 18 and transferring the ink image from the inking blanket to print substrate 20. Processor(s) 74 may include at least one conventional processor or microprocessor that interprets and executes instructions to direct specific functioning of the exemplary controller 70, and control of the image forming process with the exemplary controller.

The exemplary controller 70 may include one or more data storage devices 76. Such data storage device(s) 76 may be used to store data or operating programs to be used by the exemplary controller 70, and specifically the processor(s) 74. Data storage device(s) 76 may be used to store information regarding, for example, a current image for patterning by the imaging station 24, desired and actual fountain solution metering transfer parameters, charge density of the charge-retentive surface 22 and conductive layer 108, and digital image information with which the digital image forming device 10 and fountain solution delivery device 100 are associated.

The data storage device(s) 76 may include a random access memory (RAM) or another type of dynamic storage device that is capable of storing updatable database information, and for separately storing instructions for execution of image forming operations by, for example, processor(s) 74. Data storage device(s) 76 may also include a read-only memory (ROM), which may include a conventional ROM device or another type of static storage device that stores static information and instructions for processor(s) 74. Further, the data storage device(s) 76 may be integral to the exemplary controller 70, or may be provided external to, and in wired or wireless communication with, the exemplary controller 70, including as cloud-based data storage components.

The data storage device(s) 76 may include non-transitory machine-readable storage medium to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 70 and that causes the digital image forming device 10 and fountain solution delivery device 100 to perform any one or more of the methodologies of the present invention. The term "machine-readable storage medium" shall accordingly be taken to include, but not be limited to, solid-state memories, and optical and magnetic media.

The exemplary controller 70 may include at least one data output/display device 78, which may be configured as one or more conventional mechanisms that output information to a user, including, but not limited to, a display screen on a GUI of the digital image forming device 10, fountain solution delivery device 100, and/or associated image forming devices with which the exemplary controller 70 may be associated. The data output/display device 78 may be used to indicate to a user a status of the digital image forming device 10 with which the exemplary controller 70 may be associated including an operation of one or more individually controlled components at one or more of a plurality of separate image processing stations or subsystems associated with the image forming device.

The exemplary controller 70 may include one or more separate external communication interfaces 80 by which the exemplary controller 70 may communicate with components that may be external to the exemplary control system such as a temperature sensor, printer or other image forming device. At least one of the external communication interfaces 80 may be configured as an input port to support connecting an external CAD/CAM device storing modeling information for execution of the control functions in the image formation operations. Any suitable data connection to provide wired or wireless communication between the exemplary controller 70 and external and/or associated components is contemplated to be encompassed by the depicted external communication interface 80.

The exemplary controller 70 may include an image forming control device 82 that may be used to control the image forming process to render ink images on the print substrate 20. For example, the image forming control device 82 may control the imaging station 24 to form an electrostatic charged pattern 34 on the charge retentive reimageable surface 22, and control the fountain solution delivery device 100 to form fountain solution latent images. The image forming control device 82 may operate as a part or a function of the processor 74 coupled to one or more of the data storage devices 76, the digital image forming device 10 and fountain solution delivery device 100, or may operate as a separate stand-alone component module or circuit in the exemplary controller 70.

All of the various components of the exemplary controller 70, as depicted in FIG. 9, may be connected internally, and to the digital image forming device 10, fountain solution delivery device 100, and/or components thereof, by one or more data/control busses 84. These data/control busses 84 may provide wired or wireless communication between the various components of the image forming device 10, fountain solution delivery device 100, and any associated image forming apparatus, whether all of those components are housed integrally in, or are otherwise external and connected to image forming devices with which the exemplary controller 70 may be associated.

It should be appreciated that, although depicted in FIG. 9 as an integral unit, the various disclosed elements of the exemplary controller 70 may be arranged in any combination of subsystems as individual components or combinations of components, integral to a single unit, or external to, and in wired or wireless communication with the single unit of the exemplary control system. In other words, no specific configuration as an integral unit or as a support unit is to be implied by the depiction in FIG. 9. Further, although depicted as individual units for ease of understanding of the details provided in this disclosure regarding the exemplary controller 70, it should be understood that the described functions of any of the individually-depicted components, and particularly each of the depicted control devices, may be undertaken, for example, by one or more processors 74 connected to, and in communication with, one or more data storage device(s) 76.

Figure 10:
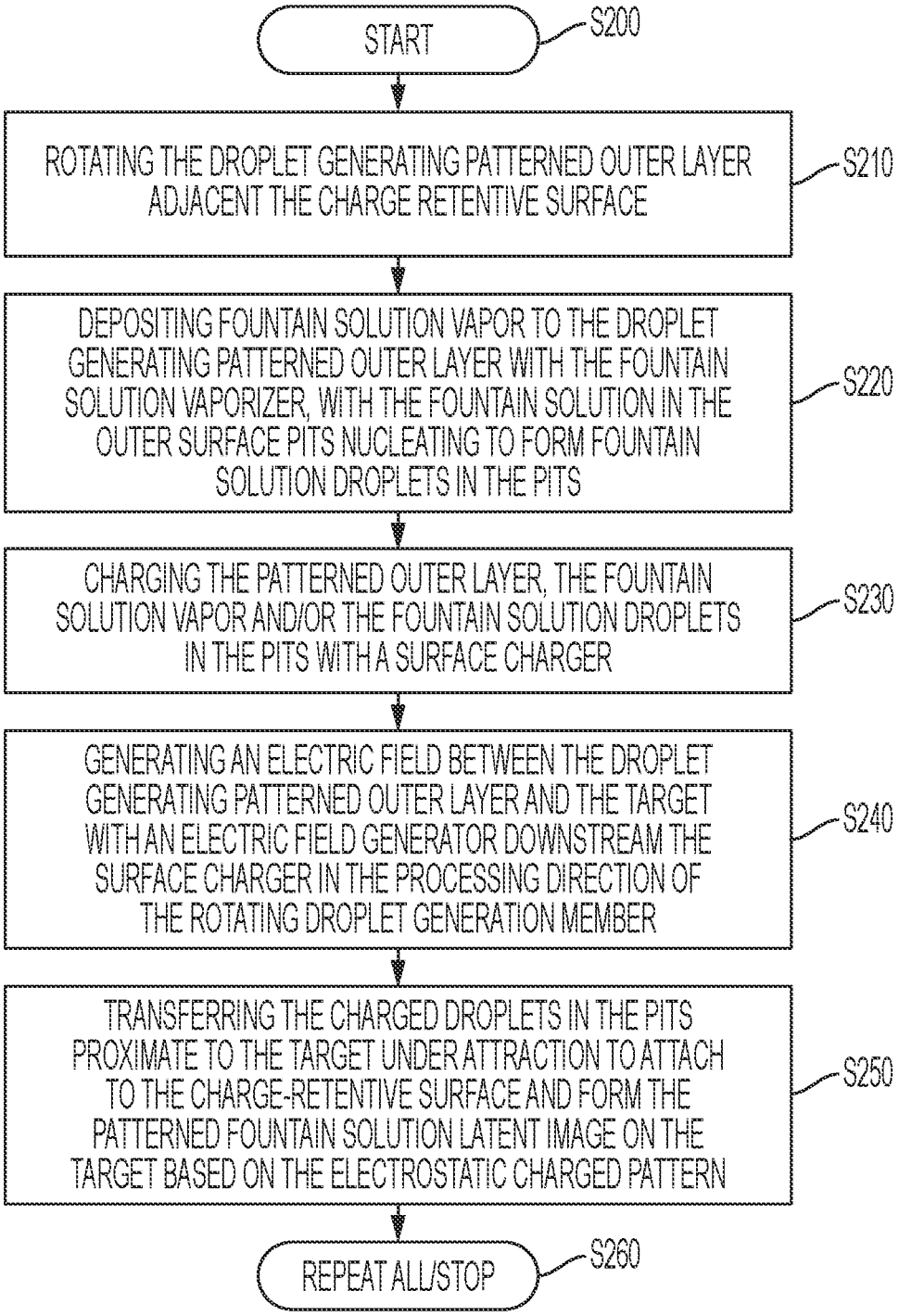
FIG. 10 is a flowchart depicting an operation of a fountain solution delivery device in accordance with examples.

The disclosed embodiments may include an exemplary method for delivering fountain solution onto a target having a charge-retentive surface bearing an electrostatic charged pattern of charged regions thereon, with the target part of an digital image forming device 10 from which an inked image may be printed. FIG. 10 illustrates a flowchart of such an exemplary method. As shown in FIG. 10, operation of the method commences at Step S200 and proceeds to Step S210.

At Step S210, the patterned outer layer 118 of the droplet generation member 102 is rotated adjacent the charge retentive reimageable surface 22 of the imaging member 16. This rotation may continue throughout the exemplary method. Operation proceeds to Step S220, where a fountain solution vaporizer 104 deposits a fountain solution vapor fog 120 to the droplet generating patterned outer layer 118 for droplet generation thereon. Fountain solution vapor particles of the fog nucleate and grow as micro-puddle size fountain solution droplets 126 in the pits 116.

Operation of Step S220 may coincide or proceed to Step S230, where before and after the fountain solution droplets 126 are fully formed, a surface charger 106 charges the droplet generating patterned outer layer, the fountain solution vapor 120 and/or the fountain solution droplets 126 to form charged fountain solution droplets 128 in the pits 116. Operation of the method may proceed to Step S240, where an electric field generator 132 downstream the surface charger 106 in the rotating processing direction of the patterned outer layer 118 generates an electric field between the patterned outer layer and the charge retentive reimageable surface 22. The generated electric field may include both DC voltage and AC voltage components to aid extraction of the charged fountain solution droplets from the pits 116 and suspension of the charged droplets in a fog thereof between the charge retentive surface 22 and the patterned outer layer 118.

Operation of the method may proceed to Step S250, where the charged droplets 130 transfer under attraction and attach to the target charge-retentive surface at the electrostatic charged pattern and form a patterned fountain solution latent image 28 on the charge-retentive surface based on the electrostatic charged pattern. The patterned fountain solution latent image may be a positive image or negative image and may be transferred from the charge-retentive surface to a transfer member inking blanket for forming an inked image thereon based on the electrostatic charged pattern. Operation may cease at Step S260, or may continue by repeating back to Step S210, to deliver additional fountain solution latent images onto the target.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 10, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fountain solution delivery device for delivering fountain solution onto a target having a charge-retentive surface bearing an electrostatic charged pattern of charged regions thereon, the delivery device comprising:

a fountain solution droplet generation member including a conductive layer having a reference potential, a dielectric layer above the conductive layer and an outer surface layer having a very low surface free energy material, the outer surface layer having pits patterned therein down to the dielectric layer to form a droplet generating patterned outer layer, the fountain solution droplet generation member being rotatable adjacent the target;

a fountain solution vaporizer in communication with the droplet generating patterned outer layer to deposit fountain solution vapor to the pits, wherein fountain solution in the pits nucleate on the dielectric layer to form fountain solution droplets in the pits; and a surface charger configured to charge the droplet generating patterned outer layer and at least one of the fountain solution vapor and the fountain solution droplets to form charged fountain solution droplets nucleated in the pits, wherein the charged fountain solution droplets proximate to the target transfer under attraction from the pits to the charge-retentive surface and form a patterned fountain solution latent image on the target based on the electrostatic charged pattern.

2. The device of claim 1, further comprising an electric field generator downstream from the surface charger in a processing direction of the rotatable fountain solution droplet generation member, the electric field generator configured to generate an electric field between the droplet generating patterned outer layer and the target and extract the charged fountain solution droplets from the pits into a fog of charged droplets.

3. The device of claim 2, the electric field generator including a baffle between the fountain solution droplet generation member and the target and extending around the outer surface layer to adjacent the target, the baffle configured to confine a migration of the fog of charged droplets between the baffle and the droplet generation member until accessing the target beyond the baffle.

4. The device of claim 3, wherein the baffle is configured to generate the electric field.

5. The device of claim 2, wherein the electric field generator is configured to generate the electric field having both DC voltage and AC voltage.

6. The device of claim 1, wherein the fountain solution droplet generation member and the target are spatially separated by a gap therebetween that is less than a millimeter.

7. The device of claim 6, further comprising spacers between the outer surface layer and the target, the spacers contacting the target at non-imaging regions thereof and maintain the gap over the electrostatic charged pattern.

8. The device of claim 1, wherein the outer surface layer very low surface free energy material includes a perfluorinated material coating.

9. The device of claim 1, wherein the outer surface layer very low surface free energy material has a surface tension lower than 20 mN/m.

10. The device of claim 1, wherein the dielectric layer has a surface energy, and the outer surface layer has a second surface energy lower than the surface energy of the dielectric layer.

11. The device of claim 1, wherein the outer surface layer and dielectric layer are temperature controlled and cooled to expedite vapor condensation in the pits.

12. A method for delivering fountain solution onto a target having a charge-retentive surface bearing an electrostatic charged pattern of charged regions thereon with the fountain solution delivery device of claim 1, comprising:

a) rotating the droplet generating patterned outer layer adjacent the charge retentive surface;

b) depositing fountain solution vapor to the droplet generating patterned outer layer with the fountain solution vaporizer, wherein fountain solution in the pits nucleate on the dielectric layer to form fountain solution droplets in the pits;

c) charging the droplet generating patterned outer layer and at least one of the fountain solution vapor and the fountain solution droplets to form charged fountain solution droplets nucleated in the pits with a surface charger; and d) transferring the charged droplets proximate to the target under attraction from the pits to attach to the charge-retentive surface and form the patterned fountain solution latent image on the target based on the electrostatic charged pattern.

13. The method of claim 12, further comprising, after Step c), generating an electric field between the droplet generating patterned outer layer and the target with an electric field generator downstream the surface charger in a processing direction of the rotatable fountain solution droplet generation member, the electric field extracting the charged fountain solution droplets from the pits into a fog of charged droplets.

14. The method of claim 13, further including confining a migration of the fog of charged droplets between the droplet generation member and a baffle until access to the target beyond the baffle.

15. The method of claim 14, further comprising generating the electric field via the baffle.

16. The method of claim 13, further comprising generating the electric field including DC voltage and AC voltage with the electric field generator.

17. The method of claim 12, wherein the surface charger charges the droplet generating patterned outer layer before Step b).

18. An imaging system useful for printing with an ink-based image forming apparatus having a target rotatable imaging member with a charge-retentive surface bearing an electrostatic charged pattern of charged regions thereon, the system comprising:

an imager adjacent the charge-retentive surface that forms the electrostatic charged pattern on the surface;

a fountain solution droplet generation member including a conductive layer having a reference potential, a dielectric layer wrapped around the conductive layer and a perfluorinated material outer surface layer, the outer surface layer having pits patterned therein down to the dielectric layer to form a droplet generating patterned outer layer, the fountain solution droplet generation member being rotatable adjacent the target;

a fountain solution vaporizer in communication with the droplet generating patterned outer layer to deposit fountain solution vapor to the pits, wherein fountain solution in the pits nucleate on the dielectric layer to form fountain solution droplets in the pits; and a surface charger configured to charge the droplet generating patterned outer layer and at least one of the fountain solution vapor and the fountain solution droplets to form charged fountain solution droplets nucleated in the pits, wherein the charged droplets in the pits proximate to the target transfer under attraction to attach to the charge-retentive surface and form a patterned fountain solution latent image on the target based on the electrostatic charged pattern.

19. The imaging system of claim 18, further comprising an electric field generator downstream from the surface charger in a processing direction of the rotatable fountain solution droplet generation member, the electric field generator configured to generate an electric field between the droplet generating patterned outer layer and the target and extract the charged fountain solution droplets from the pits into a fog of charged droplets.

20. The imaging system of claim 19, the electric field generator including a baffle between the fountain solution droplet generation member and the target and extending around the perfluorinated material outer surface layer to adjacent the target, the baffle configured to confine a migration of the fog of charged droplets between the baffle and the droplet generation member until access to the target beyond the baffle.

* * * * *